US006321061B1

(12) United States Patent
Sonobe et al.

(10) Patent No.: US 6,321,061 B1
(45) **Date of Patent: *Nov. 20, 2001**

(54) BELT NIP-TYPE TONER FIXING APPARATUS USING ELASTIC ENDLESS BELT

(75) Inventors: Saburo Sonobe, Toride; Akio Onuki, Kanagawa-ken, both of (JP)

(73) Assignee: Kinyosha Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/249,926

(22) Filed: Feb. 12, 1999

(30) Foreign Application Priority Data

Feb. 16, 1998 (JP) ..... 10-032992

(51) Int. Cl.[7] ..... G03G 15/20

(52) U.S. Cl. ..... 399/329; 399/328; 399/330; 399/333; 219/216

(58) Field of Search ..... 219/216; 399/320, 399/328, 329, 324, 330, 333; 430/124

(56) References Cited

U.S. PATENT DOCUMENTS 4,922,304 * 5/1990 Gilbert et al. ..... 399/329
5,485,260 * 1/1996 Mitsuya ..... 399/328
5,535,088 * 7/1996 Sato et al. ..... 361/225
5,614,999 * 3/1997 Kanesawa et al. ..... 399/329
5,778,296 * 7/1998 Chen et al. ..... 399/329
5,853,892 * 12/1998 Chen et al. ..... 428/421
5,873,020 * 2/1999 Matsuura et al. ..... 399/329
5,890,047 * 3/1999 Moser ..... 399/329

FOREIGN PATENT DOCUMENTS 61132972 6/1986 (JP) .
5150679 6/1993 (JP) .
2650863 5/1997 (JP) .

* cited by examiner

*Primary Examiner*—Arthur T. Grimley
*Assistant Examiner*—Hoang Ngo
(74) *Attorney, Agent, or Firm*—Volpe and Koenig, P.C.

(57) ABSTRACT

Disclosed is a belt type fixing apparatus for thermally fixing an unfixed toner layer on a paper sheet. The fixing apparatus has a heating roll and a resilient endless belt stretched by a plurality of rolls such that the endless belt is partly pressed against a part on the circumferential outer surface of the heating roll to form a nipping portion. The heating roll having a hard, non-resilient surface has a mandrel, a halogen lamp arranged inside the mandrel and a release coating layer formed on the outer circumferential surface of the mandrel.

12 Claims, 3 Drawing Sheets

BELT NIP-TYPE TONER FIXING APPARATUS USING ELASTIC ENDLESS BELT

BACKGROUND OF THE INVENTION

The present invention relates to a belt type fixing apparatus used in, for example, a copying machine, a printer, and a facsimile, particularly, to a belt type fixing apparatus for fixing an unfixed toner layer on a recording medium.

As known well, an electrophotographic image formation in, for example, a copying machine is performed by thermally fusing a powdery toner on a recording medium such as a paper sheet or a plastic sheet with a heat roll so as to fix the toner image on the recording medium.

In general, a recording medium bearing a toner image is passed through a clearance between a fixing roll comprising a mandrel and a halogen lamp arranged within the mandrel and a pressing roll so as to fuse and fix the toner under heat and pressure. Since the roll temperature is set at 200 to 250° C. and it is necessary to ensure a nip width of several millimeters, a heat resistant silicone rubber layer is formed on the circumferential surface of the mandrel of the fixing roll, and the silicone rubber layer is coated with a fluoroplastic resin layer so as to ensure release properties from the toner image.

In the conventional fixing roll of the particular construction, however, the mandrel is covered with a silicone rubber layer having a hardness of about 30° (Shore A) in a thickness of about 3 mm, leading to a poor heat conductivity and, thus, to a low fixing rate. Particularly, when it comes to a color copying machine or a color printer, it is necessary to develop color by completely fusing the toner in terms of the color reproduction, leading to requirement of the contact time and heating time about 3 times as long. as those for the fixing of a black toner image. Naturally, it is strongly required to shorten the fixing time.

Some proposals have been made in an attempt to shorten the fixing time, as follows:

(1) Decrease in Rubber Layer Thickness

If the thickness of the rubber layer is decreased, it is certainly possible to increase the heat conductivity. If the rubber layer thickness is decreased, however, the elasticity i.e. resiliency of the rubber layer is lowered, with the result that the rubber layer fails to be deformed to conform with the irregularity of the toner layer on the recording medium. It follows that a uniform fixing cannot be achieved. The low resiliency of the rubber layer gives rise to a serious problem in the case of fixing, particularly, a toner image having a large difference in thickness between the thick portion and the thin portion like a color image, or in the case of fixing a toner image on a hard medium such as an OHP film.

(2) Increase in Diameter of Fixing Roll to Increase Nip Width with Pressing Roll with the Rubber Layer Thickness Left Unchanged The contact area between the recording medium and the fixing roll can be increased in this method. If the diameter of the roll is increased, however, the heat efficiency is lowered and the apparatus is rendered bulky. To overcome these problems, proposed nowadays is a system of using a belt stretched among supporting rolls in place of the pressing roll so as to increase the nip width and, thus, to shorten the fixing time.

Japanese Patent Disclosure (Kokai) No. 5-150679 discloses a fixing apparatus comprising a thermal fixing roll prepared by forming an elastic i.e. resilient layer having a thickness of at least 0.5 mm to cover an outer circumferential surface of a mandrel and a heat resistant endless belt stretched via a plurality of supporting rolls. It is taught that the heat resistant endless belt is wound at a predetermined angle about the fixing roll so as to form a nipping portion between the heat resistant belt and the thermal fixing roll. In this prior art, the resilient layer is formed to cover the circumferential surface of the mandrel to form the thermal fixing roll because the endless belt is formed of a plastic film which is not resilient and, thus, is not deformed. Therefore, in this prior art, a pressing roll is pressed against the thermal fixing roll with the endless belt interposed therebetween so as to deform the thermal fixing roll and, thus, to form a nipping portion between the roll and the belt. In this fashion, the toner is melted and fixed. It is taught that the heat resistant endless belt is made of a polyimide film or a Teflon film sized at, for example, 75 $\mu$m in thickness, 300 mm in width and 288 mm in length.

Japanese Patent Disclosure No. 61-132972 discloses a belt type fixing apparatus, comprising a heating roll having a fluoroplastic surface layer made of, for example, Teflon and a heat resistant belt formed of polyimide. Further, Japanese Patent No. 2650863 discloses an apparatus comprising a pressing roll and a seamless belt made of polyimide.

As described above, in the conventional technique, the surface of a fixing roll is covered with a resilient material and pressed by a pressing roll so as to generate strain within the fixing roll and, thus, to fix uniformly the toner layer. In the conventional technique, however, the elastic layer inhibits the heat conduction required for the fixing, making it difficult to shorten the warming up time to heat the roll or belt to temperatures required for the fixing.

BRIEF SUMMARY OF THE INVENTION

An object of the present invention is to provide a belt type fixing apparatus comprising a heating roll and a resilient endless belt stretched by a plurality of supporting rolls such that the endless belt is partly pressed against a part on the circumferential outer surface of the heating roll to form a nipping portion, the heating roll consisting of a mandrel, a heating means arranged inside the mandrel and a release coating layer formed on the outer circumferential surface of the mandrel, and the endless belt being deformed at the nipping portion between the endless belt and the heating roll to conform with the irregularity of the toner layer so as to melt and fix uniformly the toner layer.

Another object is to provide a belt type fixing apparatus, in which some of the plural supporting rolls supporting the resilient endless belt are made movable so as to adjust the tension of the elastic endless belt and, thus, to deform the belt at the nipping portion with the heating roll.

Another object is to provide a belt type fixing apparatus, in which the resilient endless belt consists of a spiral reinforcing layer made of a continuous heat resistant string, a heat resistant elastic layer formed on the reinforcing layer, and a release coating layer formed on the heat resistant resilient layer. The particular construction of the resilient endless belt permits improving the heat conductivity, compared with the conventional heating roll using a rubber layer low in heat conductivity, so as to promptly transmit the heat generated from the heating means arranged within the heating roll to the toner layer. As a result, the toner layer is melted promptly so as to improve the fixing speed and shorten markedly the warming up time.

Another object is to provide a belt type fixing apparatus for thermally fixing an unfixed toner layer on a recording medium, comprising a heating roll and a resilient endless belt stretched by a plurality of supporting rolls such that the endless belt is partly pressed against a part on the circumferential outer surface of the heating roll to form a nipping portion, the heating roll consisting of a mandrel, a heating means arranged inside the mandrel and a release coating layer formed on the outer circumferential surface of the mandrel.

Another object is to provide a belt type;fixing apparatus, in which some of the plural supporting rolls supporting the resilient endless belt are made movable so as to adjust the tension of the elastic endless belt and, thus, to deform the belt at the nipping portion with the heating roll.

Further, a still another object of the present invention is to provide a belt type fixing apparatus, in which the resilient endless belt consists of a spiral reinforcing layer made of a continuous heat resistant string, a heat resistant resilient layer formed on the reinforcing layer, and a release coating layer formed on the heat resistant resilient layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention provides a belt type fixing apparatus comprising a heating roll and a resilient endless belt stretched by a plurality of supporting rolls such that the endless belt is partly pressed against a part on the circumferential outer surface of the heating roll to form a nipping portion, said heating roll consisting of a mandrel, a heating means arranged inside the mandrel and a release coating layer formed on the outer circumferential surface of the mandrel, and said endless belt being deformed at the nipping portion between the endless belt and the heating roll to conform with the irregularity of the toner layer so as to melt and fix uniformly the toner layer.

In the present invention, it is desirable for some of a plurality of rolls supporting the resilient endless belt to be movable so as to adjust the tension of the resilient endless belt and, thus, to deform the endless belt at the nipping portion with the heating roll.

The resilient endless belt used in the present invention consists of, for example, a spiral reinforcing layer made of a continuous heat resistant string, a heat resistant resilient layer formed on the reinforcing layer, and a release coating layer formed on the heat resistant resilient layer.

The heat resistant string used for forming the reinforcing layer includes, for example, Aramid fiber, polyamide fiber, polyimide fiber, glass fiber, carbon fiber, boron fiber, silicon carbide (SiC) fiber, tyrano fiber, alumina fiber, inorganic whisker, superconductive ceramic fiber, and music wire. The reinforcing layer made of the heat resistant string may be of a single layer structure as in the endless belt. included in the fixing apparatus shown in FIG. 4 or of a double layer structure as in the endless belt included in the fixing apparatus shown in FIG. 5, which are referred to herein later.

The material of the heat resistant resilient layer includes, for example, silicone rubber, fluorinated silicone rubber, and fluororubber. On the other hand, the material of the release coating layer includes, for example, fluorocarbon resins such as PFA (tetrafluoroethylene-perfluoroalkylvinyl ether copolymer) and PTFE (polytetrafluoroethylene).

Let us describe some examples of the present invention with reference to the accompanying drawings.

EXAMPLE 1

Figure 1:
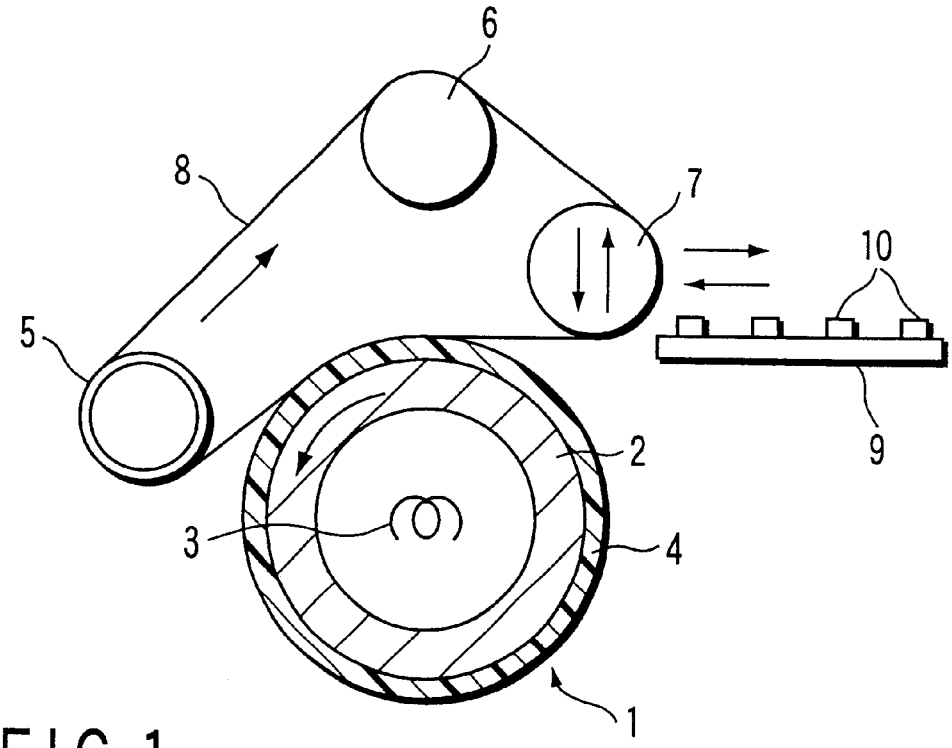
FIG. 1 schematically shows a resilient belt nipping type fixing apparatus according to Example 1 of the present invention.

FIG. 1 schematically shows an elastic belt nipping type fixing apparatus according to Example 1 of the present invention. As shown in the drawing, the fixing apparatus comprises a heating roll 1 including an aluminum mandrel 2 and a halogen lamp 3 arranged within the mandrel 2 as a heating means. A release coating layer 4 made of a fluoroplastic resin (PFA) and having a thickness of 50 to 70 $\mu$m is formed on the outer circumferential surface of the mandrel 2. The release coating layer 4 is baked to the mandrel 2 or fitted over the outer circumferential surface of the mandrel 2. A first driving roll 5, a first supporting roll 6 and a second supporting roll 7 are arranged in the vicinity of the heating roll 1. A heating means (not shown) used for the preheating is mounted in the second supporting roll 7.

The second supporting roll 7 is provided with a moving means (not shown) for moving the second supporting roll 7 in a three dimensional direction. Further, an resilient endless belt 8 having a thickness of 1 mm is stretched about the driving roll 5, the first supporting roll 6 and the second supporting roll 7 such that the belt 8 is partly brought into contact with a part of the outer circumferential surface of the heating roll 1. The nip width between the endless belt 8 and the heating roll 1 and the pressure applied by the endless belt 8 to the heating roll 1 are controlled by moving appropriately the second supporting roll,7 provided with the moving means.

Figure 3:
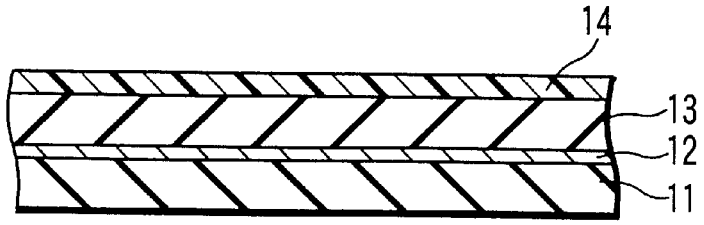
FIG. 3 is a cross sectional view showing in a planar fashion the resilient endless belt used in the elastic belt nipping type fixing apparatus shown in FIG. 1.
Figure 4:
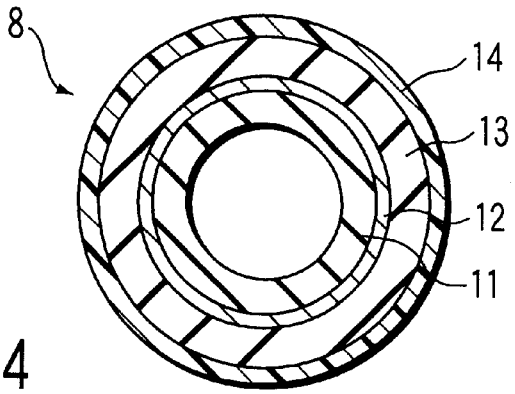
FIG. 4 is a cross sectional view showing in a circular fashion the resilient endless belt used in the elastic belt nipping type fixing apparatus shown in FIG. 1.

The resilient endless belt 8 is constructed as shown in FIGS. 3 and 4, which are cross sectional views showing the resilient endless belt 8 in planar and circular fashions, respectively. As shown in the drawings, the resilient endless belt 8 comprises a silicone rubber layer 11 and a reinforcing layer 12 spirally formed continuously on the silicone rubber layer 11. The reinforcing layer 12 in this embodiment is of a single layer structure and is made of a string of Aramid fiber (trade name of Technola T-200 manufactured by Teijin Ltd.).

An resilient rubber layer 13 made of a silicone rubber (trade name of KE-119 manufactured by Shin-etsu Kagaku K.K.) is formed on the reinforcing layer 12. Further, a release coating layer 14 exhibiting release characteristics is formed on the resilient rubber layer 13. The release coating layer 14 is resistant to heat and is made of a fluoroplastic resin (trade name of "Polyflon PFA Tough Coat Enamel" manufactured by Daikin Kogyo K.K.).

As described above, the resilient belt nipping type fixing apparatus according to Example 1 comprises the heating roll 1, the driving roll 5 arranged in the vicinity of the heating roll 1, the first and second supporting rolls 6 and 7, and the resilient endless belt 8 stretched about the driving roll 5 and the first and second supporting rolls 6 and 7. The heating roll 1 comprises the mandrel 2, the halogen lamp 3 arranged within the mandrel 2, and the release coating layer 4 made of PFA and formed on the outer circumferential surface of the mandrel 2. The second supporting roll 7 serves to adjust the nip width and the pressure applied to the heating roll 1 via the resilient endless belt 8.

A paper sheet 9 bearing a toner layer 10 is nipped between the heating roll 1 and the resilient endless belt 8. At the nipping portion, the toner layer 10 on the paper sheet 9 is melted by the heat generated from the halogen lamp 3 arranged within the heating roll 1 so as to be fixed uniformly to the paper sheet 9. It should be noted that the toner layer 10 on the paper sheet 9 is pressed by the resilient endless belt 8 at the nipping portion, with the result that the resilient endless belt 8 is deformed to conform with the irregularity of the toner layer 10 on the paper sheet 9. It follows that the toner layer 10 is melted in the nipping portion and fixed uniformly to the paper sheet 9. Incidentally, in the conventional fixing belt formed of a plastic material such as a polyimide film, it is necessary to press the belt against a resilient fixing roll to ensure a nip-width required for the fixing because the belt itself is not resilient. Of course, such a pressing is not required in the fixing apparatus of the present invention.

It should also be noted that the release coating layer 4 alone, which is made of PFA, is formed on the surface of the heating roll 1. In other words, a rubber layer, which is incapable of transmitting heat efficiently, is not formed on the surface of the heating roll 1. Naturally, the heating roll 1 included in the fixing apparatus of the present invention exhibits a heat conductivity higher than that of the conventional heating roll including a rubber layer. In the present invention, the heat generated from the halogen lamp 3 arranged within the mandrel 2 of heating roll 1 is transmitted promptly to the toner layer on a recording medium so as to melt the toner layer promptly. It follows that the fixing apparatus of the present invention permits improving the fixing speed and also permits markedly shortening the warming up time.

EXAMPLE 2

Figure 2:
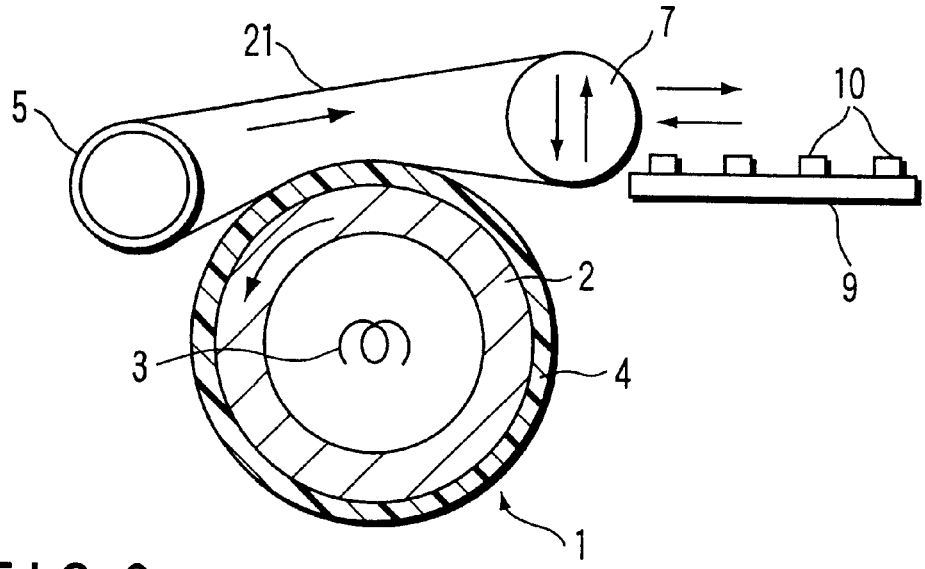
FIG. 2 schematically shows a resilient belt nipping type fixing apparatus according to Example 2 of the present invention.
Figure 5:
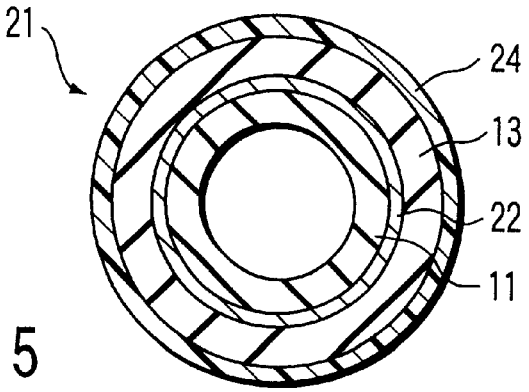
FIG. 5 is a cross sectional view showing in a circular fashion the resilient endless belt used in the elastic belt nipping type fixing apparatus shown in FIG. 2.

An elastic belt nipping type fixing apparatus according to Example 2 is schematically shown in FIG. 2. Also, FIG. 5 shows the construction of a resilient endless belt 21 included in the fixing apparatus shown in FIG. 2. As apparent from the drawings, Examples 1 and 2 are substantially equal to each other, except that the first supporting roll 6 included in Example 1 is not used in Example 2, and that the resilient endless belt 21 having a thickness of 0.8 mm is used in Example 2 in place of the resilient endless belt 8 used in Example 1.

Figure 6:
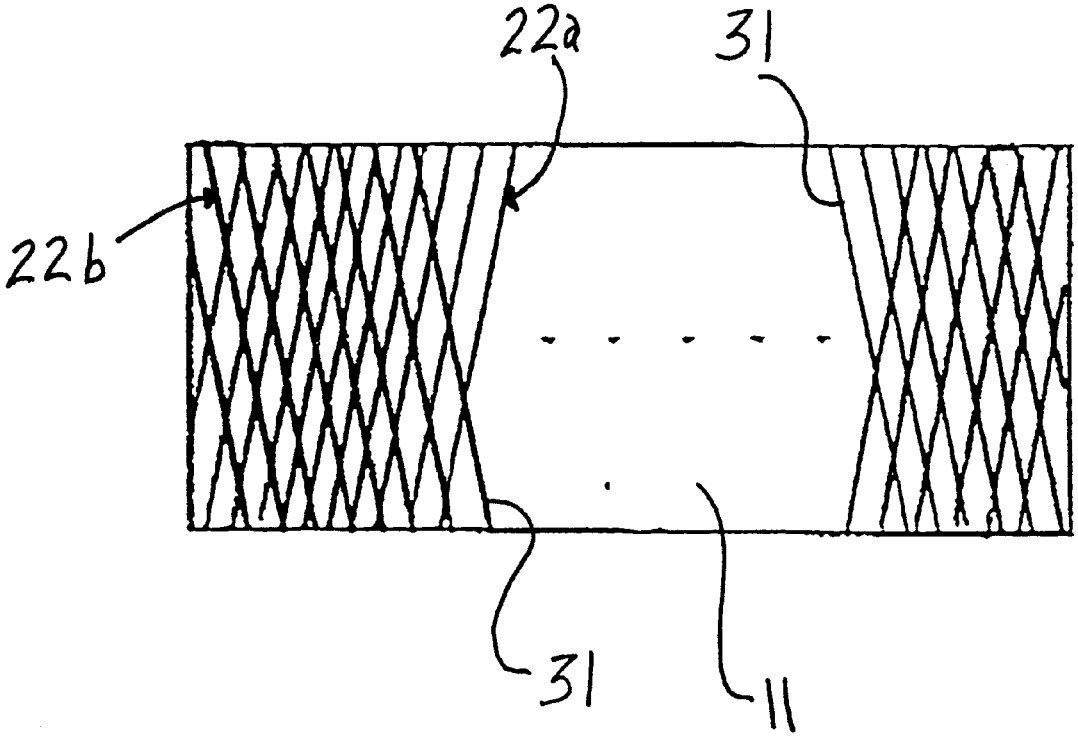
FIG. 6 is an elevated view illustrating the reinforcing layer of the elastic endless belt shown in FIG. 5.

The resilient endless belt 21 is substantially equal to the resilient endless belt 8 shown in FIG. 4, except that a reinforcing layer 22 and a fluoroplastic layer 24 are used in Example 2 (FIG. 5) in place of the reinforcing layer 12 and the fluoroplastic layer 14, respectively, used in Example 1 (FIG. 4). The reinforcing layer 22 shown in FIG. 5 is of a double layer structure as shown in FIG. 6 prepared by spirally winding a heat resistant string 31 about the silicone rubber layer 11 from one end of the silicone rubber layer 11 toward the other end to form a first string layer 22*a*, followed by winding the heat resistant string 31 about the first string layer from the other end toward said one end of the first string layer 22*a* to form a second string layer 22*b* on, the first string layer 22*a*. Further, the fluoroplastic layer 24 is formed of "Daiel Latex GL-213", which is a trade name of a fluoroplastic material manufactured by Daikin Kogyo K.K.

The resilient belt nipping type fixing apparatus of Example 2 is substantially equal in the produced effect: to the fixing apparatus of Example 1.

In each of the Examples described above, a silicone rubber layer is used as a base layer of the resilient endless belt. However, a fluororubber layer may also be used in place of the silicone rubber layer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A belt type toner fixing apparatus, comprising a heating roll and a resilient endless belt stretched by a plurality of supporting rolls such that the endless belt is partly pressed against a part of the circumferential outer surface of the heating roll to form a nipping portion, wherein said heating roll consists of a mandrel, heating means arranged inside the mandrel and a release coating layer comprised of a fluorine resin and formed on the outer circumferential surface of the mandrel, and said heating roll is arranged in a manner that the heating roll comes into contact with a back of a toner side of a recording medium when the recording medium passes said nipping portion.

2. The belt type fixing apparatus according to claim 1, wherein an optional one of said plural supporting rolls supporting the resilient endless belt is made movable so as to adjust the tension of the elastic endless belt and, thus, to deform the belt at the nipping portion with the heating roll.

3. The belt type fixing apparatus according to claim 1, wherein the resilient endless belt consists of a spiral reinforcing layer made of a continuous heat resistant string, a heat resistant resilient layer formed on the reinforcing layer, and a release coating layer formed on the heat resistant resilient layer.

4. The belt type fixing apparatus according to claim 3, wherein the material of the heat resistant string used for forming the reinforcing layer is selected from a group consisting of aramid fiber, polyamide fiber, polyimide fiber, glass fiber, carbon fiber, boron fiber, silicon carbide (SiC) fiber, tyrano fiber, alumina fiber, inorganic whisker, superconductive ceramic fiber and music wire.

5. The belt type fixing apparatus according to claim 4, wherein said reinforcing layer made of said heat resistant string is of a single layer structure or of a double layer structure.

6. The belt type fixing apparatus according to claim 3, wherein the material of said heat resistant resilient layer is selected from a group consisting of silicone rubber, fluorinated silicone rubber and fluororubber.

7. The belt type fixing apparatus according to claim 3, wherein said release coating layer is formed of a fluoroplastic material selected from a group consisting of tetrafluoroethylene-perfluoroalkyl vinyl ether copolymer and polytetrafluoroethylene.

8. A belt type fixing apparatus, comprising a heating roll having a hard and non-elastic surface and a resilient endless belt stretched by a plurality of supporting rolls such that the endless belt is partly pressed against a part of the circumferential outer surface of the heating roll to form a nipping portion, wherein said heating roll has a mandrel, heating means arranged inside the mandrel, a release coating layer defining the outer circumferential surface of the mandrel, and said heating roll is arranged in a manner that the heating roll comes into contact with a back of a toner side of a recording medium when the recording medium passes said nipping portion.

9. The belt type fixing apparatus using rubber endless belt according to claim 3 wherein said spiral reinforcing layer has a single-layer structure comprised of a heat-resisting string reeled spirally from one end of a rubber layer to an opposing end which opposes said one end.

10. The belt type fixing apparatus using a rubber endless belt according to claim 3 wherein said spiral reinforcing layer has a double-layer structure comprised of a heat-resisting string reeled spirally from one end of a rubber layer to an opposing end which opposes said one end, and successively reeled spirally from said opposing end to said one end.

11. The belt type fixing apparatus according to claim 1 wherein the resilient belt is a rubber belt.

12. The belt type fixing apparatus according to claim 8 wherein the resilient belt is a rubber belt.

* * * * *